US005761876A

United States Patent [19]

Keady

[11] Patent Number: 5,761,876

[45] Date of Patent: Jun. 9, 1998

[54] STONE WALL GUIDE AND FORMING SYSTEM

[76] Inventor: Paul Ashley Keady, Box 242, Schurz, Nev. 89427

[21] Appl. No.: 794,443

[22] Filed: Feb. 4, 1997

[51] Int. Cl.[6] ..... E04D 15/00

[52] U.S. Cl. ..... 52/749.13; 52/749.11; 52/747.11; 52/747.12; 33/406; 33/407

[58] Field of Search ..... 52/747.11, 747.12, 52/749.11, 749.13, 749.14, 749.1; 33/1 R, 1 G, 1 H, 404–408

[56] References Cited

U.S. PATENT DOCUMENTS

| | | | |
|---|---|---|---|
| 3,768,167 | 10/1973 | Viau | 33/406 |
| 4,057,903 | 11/1977 | Cantera | 33/406 |
| 4,068,427 | 1/1978 | Camardo | 52/127 |
| 4,338,728 | 7/1982 | Valead | 33/406 |
| 4,359,850 | 11/1982 | Sinkes | 33/406 X |
| 4,443,954 | 4/1984 | Clark | 33/404 |
| 4,583,343 | 4/1986 | Camp | 52/127 |
| 4,995,167 | 2/1991 | Sanchez | 33/404 |
| 5,040,344 | 8/1991 | Durand | 52/127 |
| 5,129,150 | 7/1992 | Sorensen | 33/408 |
| 5,481,836 | 1/1996 | Miller et al. | 52/127 |

*Primary Examiner*—Beth Aubrey

*Attorney, Agent, or Firm*—Patent & Trademark Services; Joseph H. McGlynn

[57] ABSTRACT

An apparatus and the method of using the apparatus to form a wall. Initially, a pair of vertical wall guides are mounted upright at selected locations. The guides are made in two parts, a front guide and a rear guide, so the guides can be moved toward and away from each other to compensate for uneven walls and thicknesses of stone. Staves or forming boards are mounted horizontally between the wall guides by threaded bolts, to form a guide for the stones. The stones are set sequentially in a horizontally disposed course using the staves as a guide to lay the wall straight and level. Additional staves are fixed to the guides as necessary. Once, it is determined that a particular row of stones has set, its restraining stave can be removed. This action usually starts at the bottom course and moves upward until all staves are removed.

7 Claims, 2 Drawing Sheets

FIG. 1
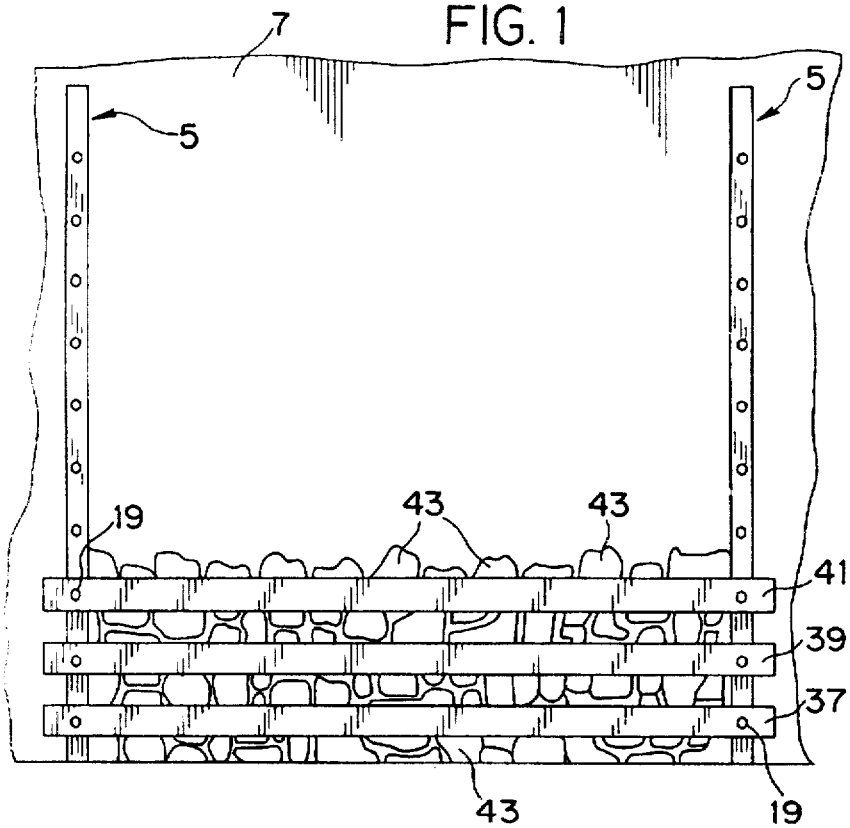
FIG. 2
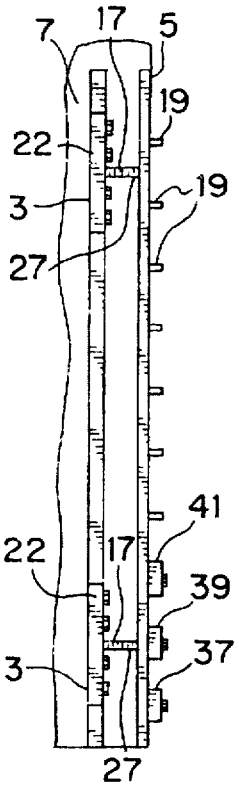
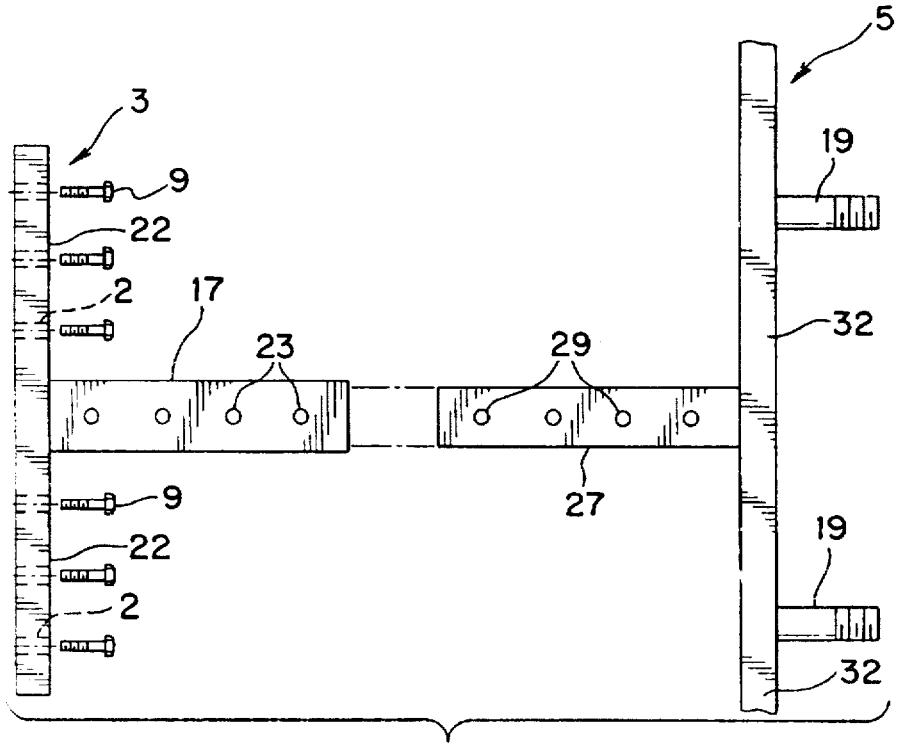
FIG. 3
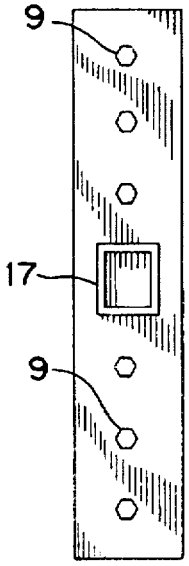
FIG. 4

STONE WALL GUIDE AND FORMING SYSTEM

BACKGROUND OF THE INVENTION

This invention relates, in general, to guides for forming stone walls, and, in particular, to a stone wall guide that allows the mason to work with stones having poor bases or feathered edges.

Bracing has been long used to temporarily support upright masonry structures, such as walls and arches, while the applied holding material for the stone, brick or tile material bonds them together. Applying a stone facing layer to an existing upright wall has been a problem particularly in residential construction as the irregular shaped stones need upright support when bonding and present a continuous danger of falling on workers during the process.

The present invention seeks to overcome these problems by providing for a stone wall guide which allows the stones to be safety braced during the building process while insuring that they are applied in a visually pleasing manner.

DESCRIPTION OF THE PRIOR ART

In the prior art various types of wall bracing systems have been proposed. For example, in U.S. Pat. No. 4,068,427 to Camardo, a temporary wall bracing system is disclosed which has a foundation and anchor plate fixed to the ground with steel stakes.

U.S. Pat. No. 4,583,343 to Camp, discloses a tile setting kit usable on a vertical surface having a starter rack with spacers for the first course of tiles and an elongated guide.

Another wall bracing system is set forth in U.S. Pat. No. 5,040,344 to Durand, which is used with spaced panels having removable shores on one panel and connected stiffeners to keep them apart.

In U.S. Pat. No. 5,481,836 to Miller et al, a wall support system is described which has a base, a chain, and cement loops whereby the chain can be tensioned by a pivotal chain lever.

The present invention differs from such prior art devices by providing an apparatus and method for setting stones or other masonry using two adjustable inner spaced wall mounted brackets that engage two outer second adjustable wall guide brackets with staves or forming boards for supporting layered vertical courses of stones of varying thickness as more further set forth in this specification.

SUMMARY OF THE INVENTION

This invention relates to an apparatus and the method of using the apparatus to form a wall. Initially, a pair of vertical wall guides are mounted upright at a selected location. The guides are made in two parts, a front guide and a rear guide, so the guides can be moved toward and away from each other to compensate for uneven walls and/or thicknesses of stone. Staves or forming boards are mounted horizontally between the wall guides by threaded bolts, to form a guide for the stones. The stones are set sequentially in a horizontally disposed course using the staves as a guide to lay the wall straight and level. Additional stays are fixed to the guides as necessary. Once, it is determined that a particular row of stones has set, its restraining stave or forming board can be removed. This action usually starts at the bottom course and moves upward until all staves are removed.

Thereafter, the stones are cleaned and excess bonding material removed. If more than one section of the wall is to be built, e.g., two straight sections or a straight and curved section, the process is repeated for each section. Finally, after the stone bonding material has set, the stonework is sealed by applying a sealer.

It is the primary object of the present invention to provide for an improved apparatus to form a stone wall.

Another object is to provide for the method of using the apparatus.

These and other objects and advantages of the present invention will become apparent to readers from a consideration of the ensuing description and the accompanying drawings.

BRIEF DESCRIPTION OF THE DRAWINGS

FIG. 1 is a front view of the invention's preferred embodiment with three staves in place.

FIG. 2 is a side view of the FIG. 1 embodiment.

FIG. 3 shows a side view of the adjustable wall guide mounting brackets.

FIG. 4 shows an enlarged front view of the FIG. 3 adjustable wall guide mounting brackets.

DESCRIPTION OF THE PREFERRED EMBODIMENT

Figure 5:
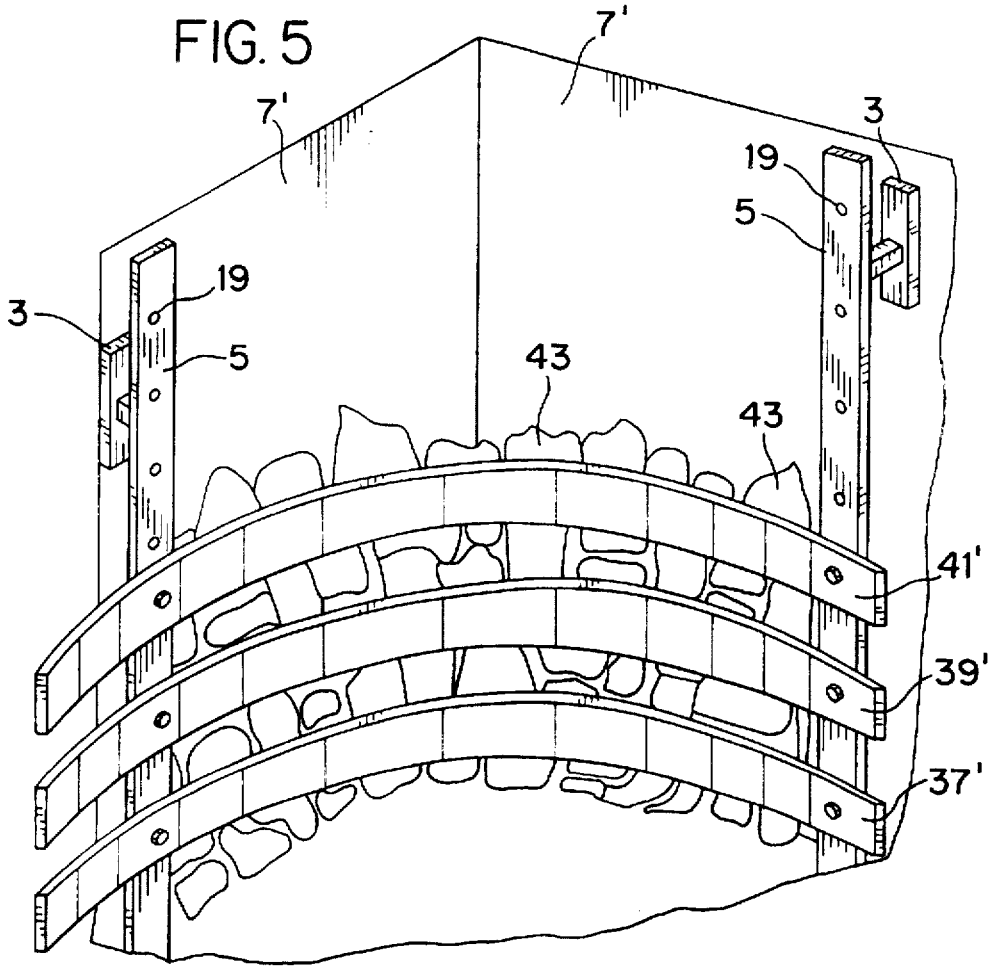
FIGS. 5–6 show front and top views, respectively, of the invention's preferred embodiment when used to mount stones around a corner.

FIG. 1 is a front view of the invention's preferred embodiment with three staves 37, 39, 41 attached to the guides 3, 5. The guides 3 and 5 are mounted vertically to a support wall 7, as will be described in greater detail below. The guides should be made of rectangular steel stock, however, any rigid, durable material could also be used.

As can be seen in FIGS. 2 and 3, the guides are made in two parts in order to allow for adjustments for uneven walls. Each guide has a front portion 5 and a rear portion 3. The front portion 5 is essentially T-shaped with a pair of arms 32 joined to a stem 27. The arms 32 are flat and have a plurality of threaded bolts 19 attached thereto. The bolts could be unitary with the arms, or they could be made separate and attached at a later time by any conventional means such as, but not limited to, welding.

The stem 27 is preferably a tubular member, although it could also be a flat, rectangular member. A plurality of apertures 29 extend through the stem 27, for a purpose to be described later.

The rear guide 3 is also a T-shaped member having arms 22, and a stem 17. The arms 22 have a plurality of apertures 2 therethrough which will receive fasteners such as screws or nails 9 in order to secure the guide 3 to a support wall 7. The stem 17 is preferably a tubular member, although it could also be a flat, rectangular member. A plurality of apertures 23 extend through the stem 17. If the stem 17 is tubular, its inside dimension should be slightly larger than the outside dimension of stem 27, so the two stems can telescope. The telescoping feature allows the user to adjust the distance the outer guide 5 will be placed from the support wall 7.

In order to install the guides on a support wall 7 the rear guide 3 will first be attached by the fasteners 9, then the stem 27 will be inserted into the stem 17 until the front guide is positioned the proper distance from the support wall and at least one of the apertures 23 is aligned with one of the apertures 29. A fastener, such as a nail or bolt will be inserted through the aligned apertures to hold the guides in position.

It should be noted that the front guide 5 is shown as a single, long piece, and the rear guide 3 is shown as a plurality of short pieces. This is merely for illustration purposes, and both guides could be a single, long piece, a plurality of short pieces, or the rear guide could be a single, long piece and the front guide could be made as short pieces.

Figure 6:
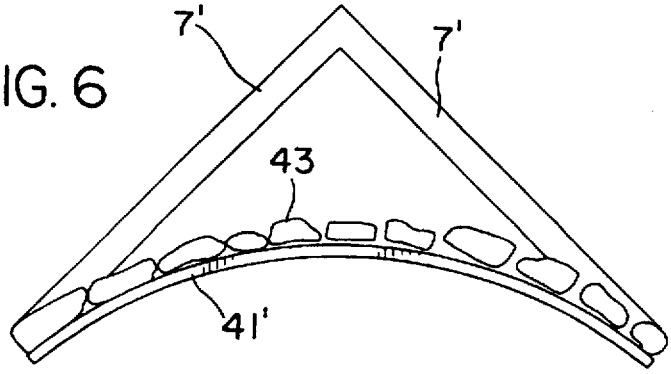

Once the guides are in proper position, the staves 37, 39, 41 can be attached to the front guide 5. Each stave will have at least two apertures extending therethrough, which can be placed on the bolts 19 and secured by conventional nuts, not shown. The staves or forming boards are preferably made from ½ inch plywood, although other materials can be used. For example, if a straight wall is being formed, as shown in FIG. 1, standard 2×6's could be used. If a curved wall is being built, as shown in FIGS. 5 and 6, the staves should be made from a material that is slightly flexible, such as plywood, so it can be bent to form the curved walls.

Once the staves are set, stones 43 can be placed with a face of the stone tight against the inside surface of one or more staves. Mortar will be placed around the stones except on the face. Additional stones will be positioned and mortared in place until another stave is needed. Additional staves will be attached as the wall progresses upwardly.

The support staves are left in place until the mortar has set and then the staves can be removed starting from the bottom up. When in place, the staves insure that the stones 43 will not move out of position, because of a poor base or feathered edges, until the mortar has set. Once the mortar has set, excess mortar can be removed and the stones 43 can be cleaned. Once the mortar has cured, the stone work can be sealed with any conventional stone sealer.

The described apparatus is used as follows. First, the worker determines how much of the wall is to be covered by stone. This spacing is plumbed vertically using two scribed chalk lines on the wall 7, 7'. The nearest studs outside of this spacing are then located and the inner guides 3 are attached to the wall with the stems 17 extending away from the wall. Next, the stems 27 are slipped into the stems 17, and adjusted toward and/or away from the wall 7, 7', and secured by the aligned apertures 23, 29. The staves are the attached to the bolts 19 on outer guide 5. The staves will be held in place by nuts. A stone is then placed between the staves and the wall 7, 7', with ample amounts of mortar on all sides, except the face of the stones. This process is continued from the ground up until the stone wall is finished.

Excess mortar is removed and the stonework is cleaned over and over until no loose mortar is left exposed on it. Once fully cured, the stone wall can be sealed with a variety of sealers some of which may produce a glossy surface while others are visually undetectable.

The preferred embodiment is concerned with a wall constructed of stones cemented or mortared together. The same underlying principles and apparatus for building this wall with slight modifications could be used to build a wall made of any bonded objects such as bricks, cinder blocks, clay blocks, etc.

Although the Stone Wall Guide and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for guiding the formation of a wall adjacent to a support wall comprising:

at least one inner guide, said inner guide having at least one vertically disposed arm and a horizontal stem attached thereto, said horizontal stem of said inner guide having a plurality of apertures therethrough, said vertical arm having means for mounting said inner guide on said support wall, at least one outer guide, said outer guide having at least one vertically disposed arm and a horizontal stem attached thereto, said horizontal stem of said outer guide having a plurality of apertures therethrough, said horizontal stems being telescoped together and secured by a fastening means extending through at least one aperture on said horizontal stem of said inner guide and at least one aperture on said horizontal stem of said outer guide, means on said outer guide for securing a horizontal stave thereto, at least one stave mounted on said outer guide, whereby said stave can be used as a guide in forming a wall.

2. The apparatus for guiding the formation of a wall as claimed in claim 1, wherein said wall is formed from stones mortared together.

3. The apparatus for guiding the formation of a wall as claimed in claim 1, wherein said horizontal stems are tubular elements, one of said horizontal stems being smaller than the other of said horizontal stems, whereby said stems can telescope together.

4. The apparatus for guiding the formation of a wall as claimed in claim 1, wherein said at least one stave is a straight member extending between two of said outer guides.

5. The apparatus for guiding the formation of a wall as claimed in claim 1, wherein said at least one stave is a curved member extending between two of said outer guides.

6. A method of forming a wall using the apparatus as claimed in claim 1, comprising the steps of:

attaching at least two of said inner guides to said support wall, attaching at least one of said outer guides to each of said inner guides, adjusting the spacing between said outer guides and said vertical support structure by moving said outer guides with respect to said inner guides, securing said outer guides to said inner guides, and fastening at least one stave between said outer guides to retain objects therebetween.

7. The method of forming a wall as claimed in claim 6, wherein said bonded objects are stones mortared to each other, and including the additional steps of cleaning said stones of excess mortar after they are set, and then applying a protective seal to said stones.

* * * * *